US012704344B2

(12) United States Patent
Faifer

(10) Patent No.: US 12,704,344 B2
(45) Date of Patent: Aug. 11, 2026

(54) BIPOD FOR A SMALL ARMS WEAPON, VARIABLY SELECTABLE SURFACE INTERFACE APPARATUS, AND METHOD FOR RECONFIGURING SAME

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 18/414,156

(22) Filed: Jan. 16, 2024

(65) Prior Publication Data

US 2024/0263906 A1 Aug. 8, 2024

Related U.S. Application Data

(63) Continuation-in-part of application No. 29/721,355, filed on Jan. 20, 2020, now Pat. No. Des. 1,012,219.

(60) Provisional application No. 63/480,072, filed on Jan. 16, 2023.

(51) Int. Cl.
*F41A 23/10* (2006.01)

(52) U.S. Cl.
CPC ..... *F41A 23/10* (2013.01)

(58) Field of Classification Search
CPC ..... F41A 23/08; F41A 23/10; F41A 23/12; F41A 23/14; F41A 23/04; F41A 23/06; F16M 11/00; F16M 11/26; F16M 11/28; F16M 11/30; F16M 11/32; F16M 11/34; F16M 11/36
See application file for complete search history.

(56) References Cited

U.S. PATENT DOCUMENTS

| | | | | | |
|---|---|---|---|---|---|
| 2,283,422 | A * | 5/1942 | Chamberlain, Jr. | F16M 11/42 | 248/186.1 |
| 4,199,123 | A * | 4/1980 | Weber | F16M 11/34 | 248/168 |
| 4,640,482 | A * | 2/1987 | Rogers | F16M 11/32 | 248/188 |
| 7,604,207 | B2 * | 10/2009 | Hasloecher | F16M 11/34 | 16/34 |
| 7,654,494 | B2 * | 2/2010 | Cartoni | G03B 17/561 | 248/163.1 |
| 7,841,122 | B1 * | 11/2010 | Hansen | F41A 23/08 | 24/595.1 |
| 10,309,581 | B2 * | 6/2019 | Underwood | F16B 7/105 | |
| 10,401,114 | B2 * | 9/2019 | Floyd | F41A 23/06 | |
| 11,002,503 | B2 * | 5/2021 | Floyd | F41A 23/06 | |
| 11,125,525 | B2 * | 9/2021 | Barnett | F41A 23/02 | |

(Continued)

*Primary Examiner* — Benjamin P Lee
(74) *Attorney, Agent, or Firm* — Law Office of Arthur M. Antonelli, PLLC

(57) ABSTRACT

A variably selectable surface interface (VSSI) for the leg of a small arms bipod is disclosed. The VSSI may include a modular anchor 26. The modular anchor may include a body 40 and a distal support member 24 pivotably connected to the body. The distal support member may include an articulating surface interface (ASI) 42 and a control mechanism 44 for selectively fixing the ASI with respect to the body. The control mechanism may include a disperse load-bearing configuration 120 such that the VSSI is arranged with respect to the body to form a disperse load-bearing support (e.g., a claw-shaped support). Also, the control mechanism may include a point force load bearing configuration 140 such that the VSSI is arranged with the body to form a point force load bearing support (e.g., a spike-shaped support).

19 Claims, 8 Drawing Sheets

(56) References Cited

U.S. PATENT DOCUMENTS

| | | | | |
|---|---|---|---|---|
| 12,085,415 | B2 * | 9/2024 | Gabbard | F16M 11/245 |
| 2003/0234326 | A1 * | 12/2003 | Crain | F16M 11/28<br>248/176.1 |
| 2004/0004168 | A1 * | 1/2004 | Crain | F16M 13/02<br>248/176.1 |
| 2006/0278797 | A1 * | 12/2006 | Keng | F16M 11/26<br>248/440.1 |
| 2009/0126250 | A1 * | 5/2009 | Keng | F41A 23/10<br>42/94 |
| 2017/0370517 | A1 * | 12/2017 | Underwood | F16B 7/105 |
| 2019/0390819 | A1 * | 12/2019 | Underwood | A47F 5/14 |
| 2020/0300573 | A1 * | 9/2020 | Barnett | F41A 23/08 |
| 2021/0063107 | A1 * | 3/2021 | Favory | F41A 23/10 |
| 2023/0017652 | A1 * | 1/2023 | Gabbard | F16M 11/36 |
| 2023/0062070 | A1 * | 3/2023 | Delgado | H01R 24/78 |
| 2024/0191833 | A1 * | 6/2024 | Gans | F16M 11/24 |
| 2025/0027736 | A1 * | 1/2025 | Salazar | F41A 23/06 |

* cited by examiner

BIPOD FOR A SMALL ARMS WEAPON, VARIABLY SELECTABLE SURFACE INTERFACE APPARATUS, AND METHOD FOR RECONFIGURING SAME

CROSS-REFERENCE TO RELATED APPLICATIONS

This application claims the benefit of U.S. Provisional Application No. 63/480,072 filed Jan. 16, 2023. This application is a continuation-in-part of U.S. patent application Ser. No. 29/721,355 filed Jan. 20, 2020. The entire disclosure of each of the U.S. Patent applications mentioned in this paragraph is incorporated by reference herein.

FIELD OF THE INVENTION

The invention generally relates to a bipod for a firearm. More particularly, the invention relates to a bipod and a variably selectable surface interface for a bipod support.

BACKGROUND

Bipods for small arms are known in the related art. These devices may be used to stabilize a firearm during use.

SUMMARY

A variably selectable surface interface (VSSI) for a small arms bipod leg is disclosed. The VSSI may include a modular anchor for connecting to a small arms bipod leg, a body mated to the modular anchor, and a distal support member pivotably connected to the body. The modular anchor may include a base, a stem and latch. The modular anchor may be configured and adapted to be selectively received in a receptacle of a small arms bipod leg. The distal support member may include an articulating surface interface, and a control mechanism for selectively fixing the articulating surface interface with respect to the body. The control mechanism may include a first disperse load bearing configuration such that the variably selectable surface interface is arranged with respect to the body to form a disperse load bearing support. Additionally, the control mechanism may include a first point force load bearing configuration such that the variably selectable surface interface is arranged with the body to form a point force load bearing support.

The control mechanism may include a tubular drive cylinder and a coil spring, The tubular drive cylinder and the coil spring may be housed in the body. The tubular drive cylinder and the coil spring may bias the articulating surface interface with respect to the body. The control mechanism further may include a locking bar for blocking relative movement between the body and the articulating surface interface. The articulating surface interface may include a first receptacle, and in the first disperse load-bearing configuration the first receptacle and the locking bar may interlock to fix the articulating surface interface with respect to the base to form the disperse load-bearing support. For instance, the disperse load bearing support may be claw-shaped. Also, the articulating surface interface may include a second receptacle, and in the first point force load bearing configuration the locking bar and the second receptacle may interlock to fix the articulating surface interface with respect to the base to form the point force load bearing support. For instance, the point force load bearing support may be spike-shaped.

Additionally, a method of reconfiguring a bipod for a small arms weapon is disclosed. The method may include providing a bipod for a small arms weapon comprising a first leg assembly which comprises a rubberized foot, providing a variably selectable surface interface in accordance with this disclosure; and replacing the rubberized foot in the first leg assembly with the variably selectable surface interface.

A bipod for a small arms or light weapon is disclosed. The bipod may include a head portion for connecting to a small arms or light weapon. For instance, the head portion may include a clamp. The clamp may be configured and dimensioned to be secured to an accessory rail. For example, the accessory rail may be a Picatinny rail. The bipod further may include a first leg assembly connected to the head portion. The first leg assembly may include a first elongated member, and a first variably selectable surface interface connected to the first elongated member. The first variably selectable surface interface may include a first body connected to the first elongated member, and a first distal support member pivotably connected to the first body. The first distal support member may include a first articulating surface interface and a first control mechanism for selectively fixing the first articulating surface interface with respect to the first body. The first control mechanism may include a first disperse load bearing configuration such that the first variably selectable surface interface is arranged with respect to the first body to form a first disperse load-bearing support (e.g., a claw-shaped support). Additionally, the first control mechanism may include a first point force load bearing support configuration such that the first variably selectable surface interface is arranged with the first body to form a first point force load bearing support (e.g., a spike-shaped support).

The bipod further may include a second leg assembly connected to the head portion. The second leg assembly may include a second elongated member, and a second variably selectable surface interface connected to the second elongated member. The second variably selectable surface interface may include a second body connected to the second elongated member, and a second distal support member pivotably connected to the second body. The second distal support member may include a second articulating surface interface and a second control mechanism for selectively fixing the second articulating surface interface with respect to the second body. The second control mechanism may include a second disperse load bearing configuration such that the second variably selectable surface interface is arranged with respect to the second body to form a second disperse load-bearing support (e.g., a claw-shaped support). Additionally, the second control mechanism may include a second point force load bearing support configuration such that the second variably selectable surface interface is arranged with the second body to form a second point force load bearing support (e.g., a spike-shaped support).

A method of supporting a firearm with a surface is disclosed. The method may include providing a bipod in accordance with the disclosure, securing the head portion to a firearm, deploying the first leg assembly to support the firearm on a surface, changing the first variably selectable surface interface from the first disperse load bearing configuration to the first point force load bearing support configuration, and implanting the first variably selectable surface interface into the surface to support the firearm. Also, the method may include replacing the first variably selectable surface interface with another distal support which includes a rubberized foot.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
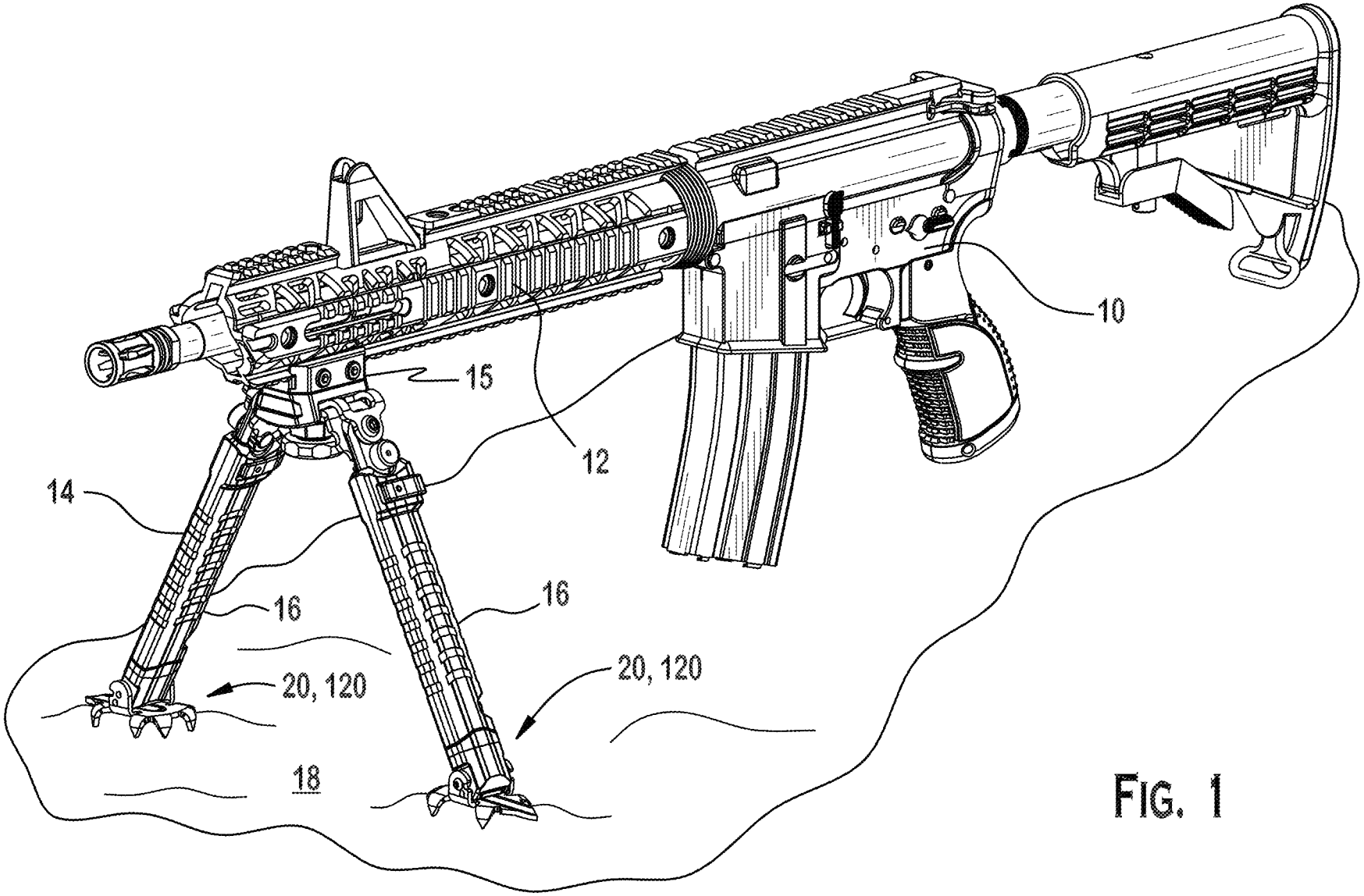
FIG. 1 is a perspective view of an illustrative long arm and an exemplary embodiment of a bipod and variably selectable surface interface for a load bearing support.
Figure 10:
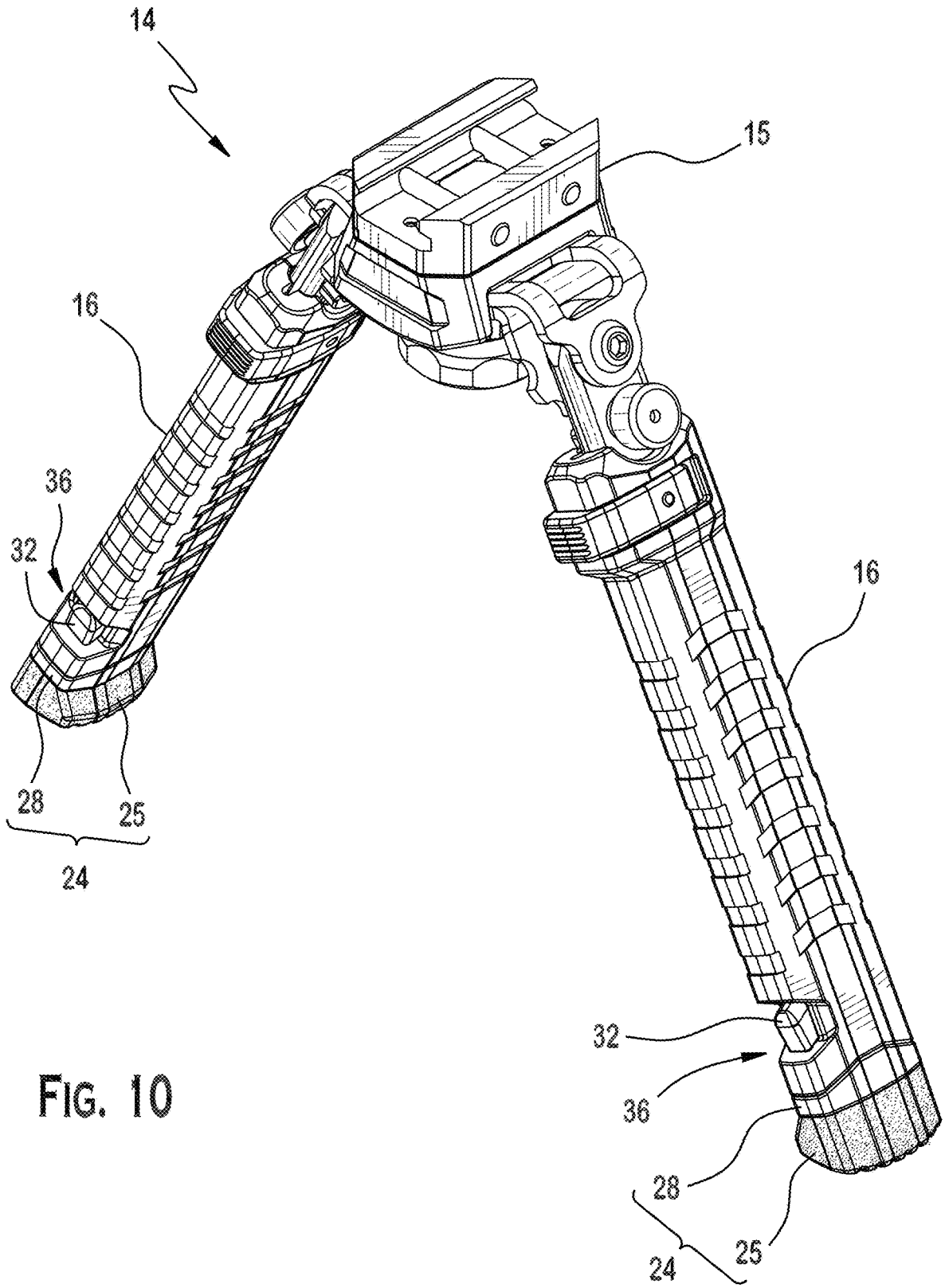
FIG. 10 shows the illustrative bipod of FIG. 1 with another distal support member including a rubberized foot.

FIG. 1 shows a perspective view of an illustrative firearm 10 and a handguard assembly 12 with an exemplary embodiment of a bipod 14 and a variably selectable surface interface 20. Generally, the bipod may be secured to small arms weapon. For instance, a head portion 15 of the bipod may be secured to a handguard assembly of a firearm (e.g., a rifle or carbine). Referring to FIG. 1 and FIG. 10, the head portion may include a clamp that is secured to an accessory rail on the handguard assembly. As shown in FIG. 1, the bipod 14 may be deployed to support the front end of the firearm 10 with each bipod support (or leg) 16 bearing on a surface 18.

Figure 9:
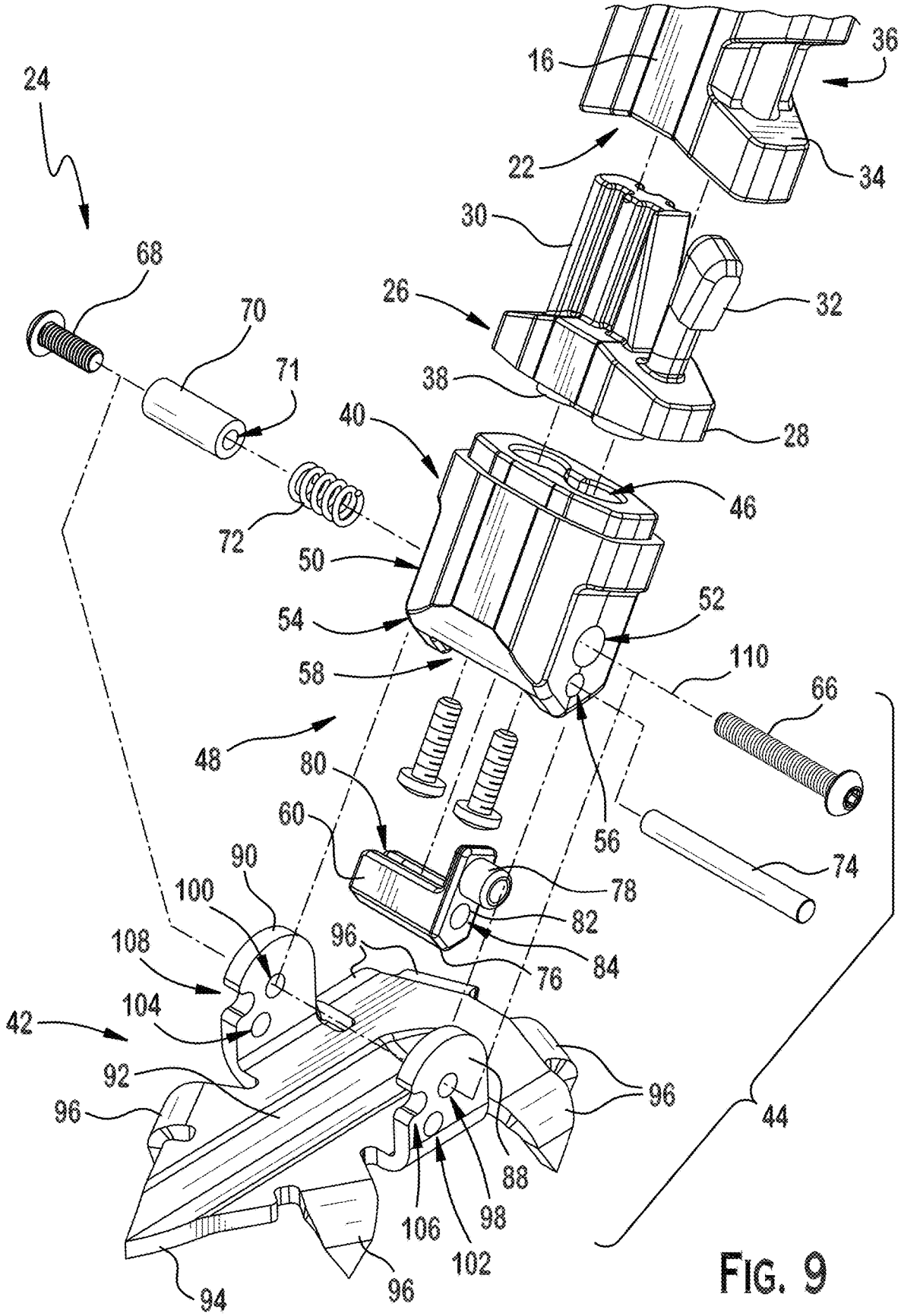
FIG. 9 is an exploded view of the variably selectable surface interface of FIG. 2.

Referring to FIG. 9, a bipod support 16 may include a modular receptacle 22 for selectively receiving a distal support member 24. For instance, the modular receptacle 22 may be configured and dimensioned to selectively receive an anchor 26. For example, the anchor 26 may include a base 28, a stem 30 and latch 32. The stem 30 and the latch 32 may be received in the modular receptacle 22. Additionally, the latch 32 may interlock with a catch 34 that is associated with the modular receptacle 22. For example, the catch 34 may be part of an opening 36 on the side of the modular receptacle 22. The opening 36 may be configured and dimensioned to interlock with the latch 32 when the stem 30 is arranged in the modular receptacle 22. Further, the opening 36 may be configured to allow the latch 32 to be selectively depressed by an operator to unlock the anchor base 28 from the modular receptacle, thereby allowing the base 28 to be separated from the modular support 18. The anchor base 28 further may include a plug 38 for receiving a body 40 of the distal support member 24. Although the distal support member may include a rubber coated or rubberized foot 25 (see FIG. 10), the distal support member 24 may include an articulating surface interface (ASI) 42 (see FIG. 9).

Figure 6:
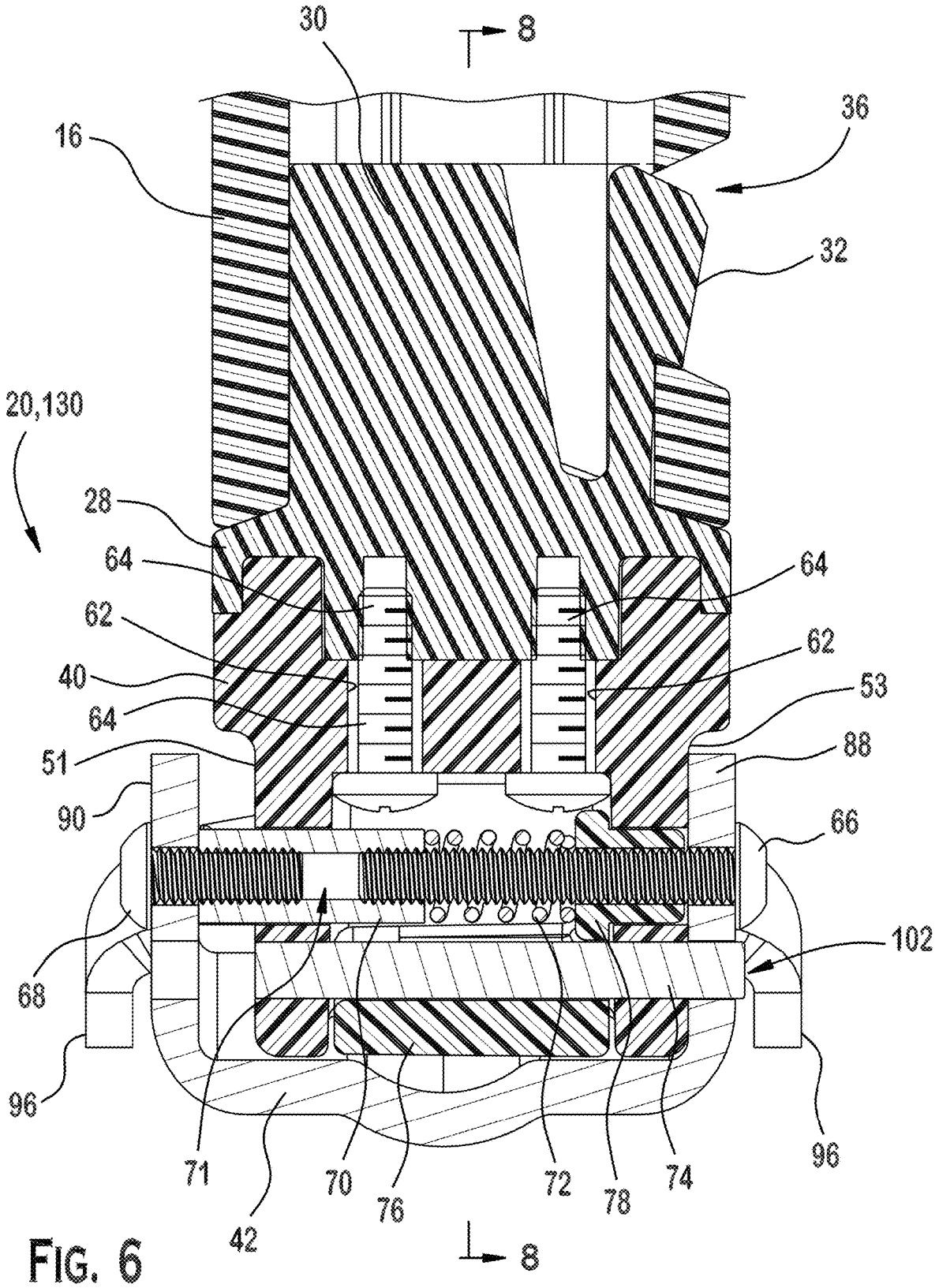
FIG. 6 is a cross-sectional view of the variably selectable surface interface of FIG. 2 along line 6-6.
Figure 7:
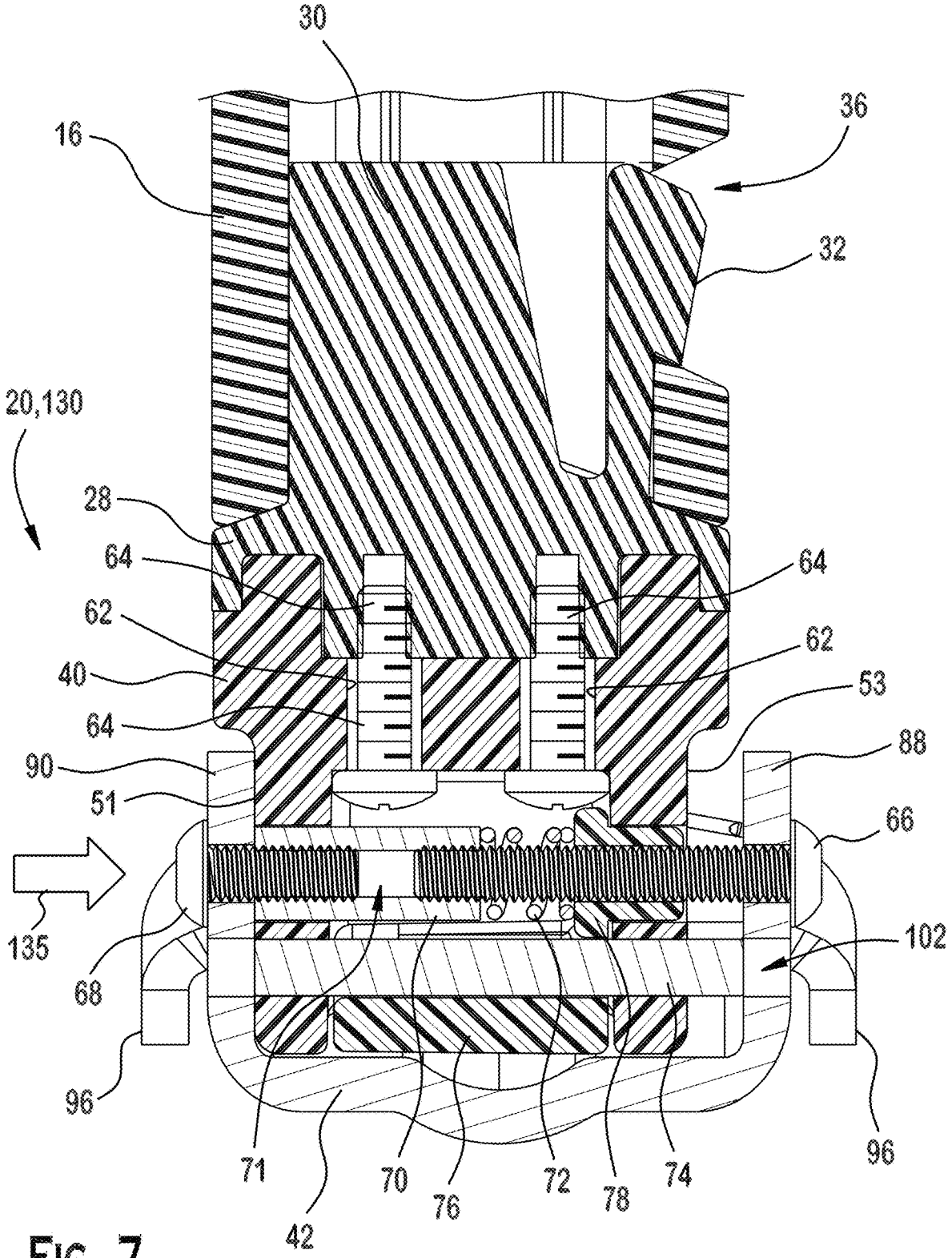
FIG. 7 is a cross-sectional view of the variably selectable surface interface of FIG. 3 along line 7-7.

In an exemplary embodiment, the variably selectable surface interface 20 may include a body 40, an ASI 42, and a control mechanism 44 for selectively articulating and locking the ASI 42. Referring to FIGS. 6, 7 and 9, the body 40 may include a proximal receptacle 46 that is configured and dimensioned to mate with the plug 38 of the base 28, as well as a control mechanism housing 48. The control mechanism housing 48 may include a starboard axial bore 50, a port axial bore 52, a starboard locking bar receiving bore 54, a port locking receiving bore 56, and a distal opening 58. The distal opening 58 may be configured and dimensioned to receive a distal cap 60. Additionally, the body 40 may include a pair of fastener receiving bores 62 which may extend from the distal opening 58 to the proximal receptacle 46. A pair of threaded fasteners 64 may be arranged in the pair of fastener receiving bores 62 and the anchor base 28 to secure the body 40 to the anchor 26.

Figure 8:
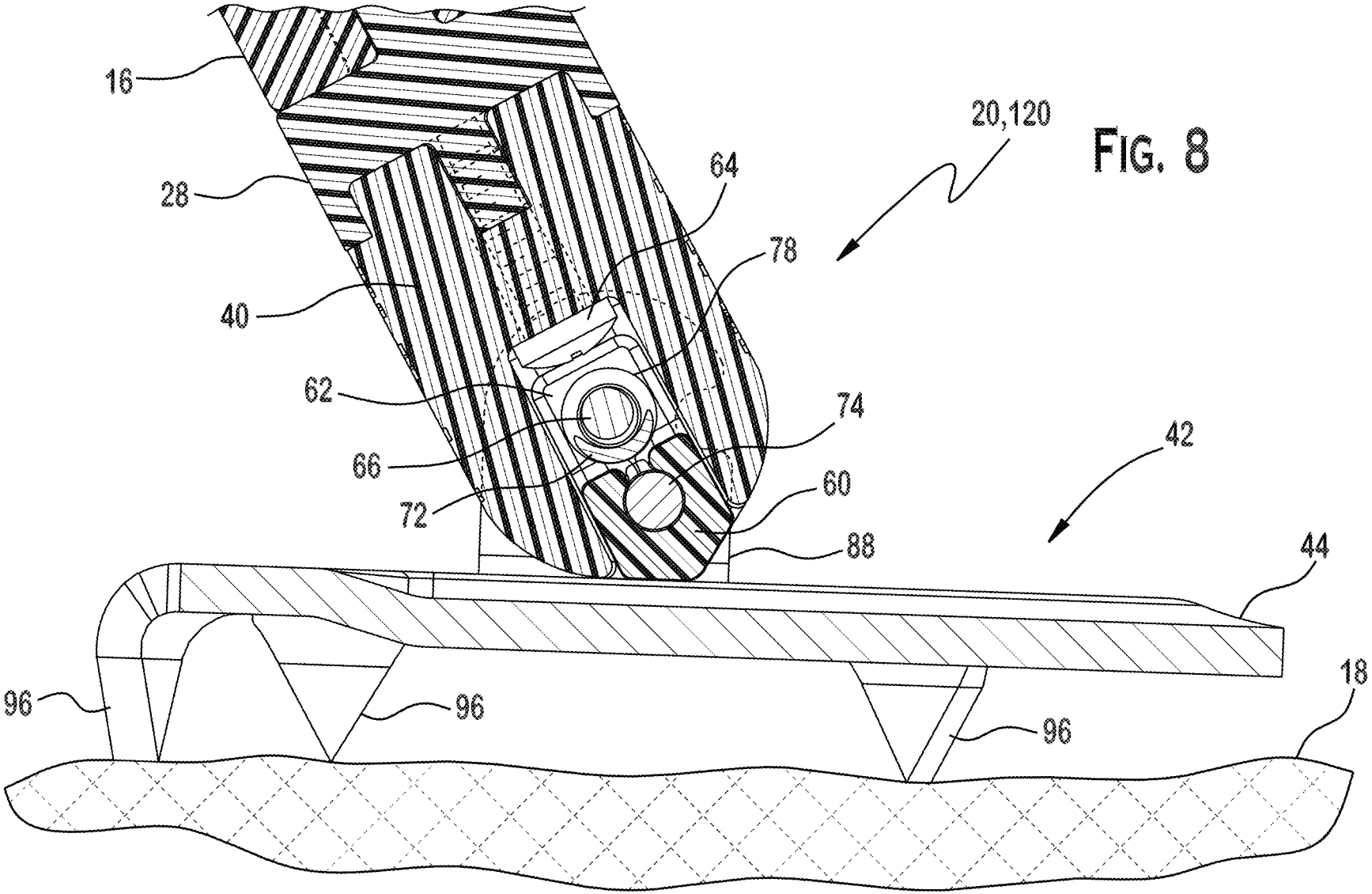
FIG. 8 is a cross-sectional view of the variably selectable surface interface of FIG. 6 along line 8-8.

Referring to FIG. 9, the control mechanism 44 further may include a port fastener 66, a starboard fastener 68, a tubular drive cylinder 70, a coil spring 72, and a locking bar (or cylinder) 74. Referring to FIGS. 8 and 9, the distal cap 60 may include a distal end 76, a bushing 78 spaced from the distal end, and a channel 80 disposed between the distal end 76 and the bushing 78. The distal cap 60 further may include a port side wall 82 and a port side opening 84 which connects the port side wall 82 and the channel 80. Referring to FIGS. 6 and 7, the bushing 78 may be configured and dimensioned to seat inside the port axial bore 52, and the channel 80 may be configured and dimensioned to align with the starboard locking bar receiving bore 54 and the port locking receiving bore 56 when the bushing 78 is arranged in the port axial bore 54. The channel 80 may hold the locking bar (or cylinder) 74 which interfaces with the ASI 42, the starboard locking bar receiving bore 54, and the port locking receiving bore 56 to selectively fix the orientation of the ASI 42 with respect to the body 40.

Referring to FIGS. 2, 3, 4, 5 and 9, the ASI 42 may include a base plate 86, a port mounting bracket 88, and a starboard mounting bracket 90. The base plate 86 further may include a V-shaped trough 92, a distal spike 94, and a plurality of claws 96. The port mounting bracket 88 and the starboard mounting bracket 90 may each include a center through hole 98, 100, an offset through hole 102, 104, and a forward-facing notch 106, 108.

Referring to FIGS. 6 and 7, the port center through hole 98 may be positioned adjacent to the port axial bore 52. The port fastener 66 may be arranged through the port center hole 98, and the bushing 78. The coil spring 72 may be positioned around the port fastener 66 adjacent to the bushing 78. The tubular drive cylinder 70 may be inserted into the starboard axial bore 50. Further, the port fastener 66 may be advanced into the threaded bore 71 of the tubular drive cylinder 70. The starboard mounting bracket 90 may be positioned such that the starboard center through hole 100 is positioned adjacent to the starboard axial bore 50. The starboard fastener 68 may be arranged through the starboard axial bore 50 and advanced into the threaded bore 71 of the tubular drive cylinder 70. In this manner, the starboard fastener 68, starboard mounting bracket 90, tubular drive cylinder 70, port mounting bracket 88, and port fastener 66 may be connected to form a drive assembly. The starboard fastener 68, tubular drive cylinder 70, and port fastener 66 may define a transverse axis 110.

Figure 2:
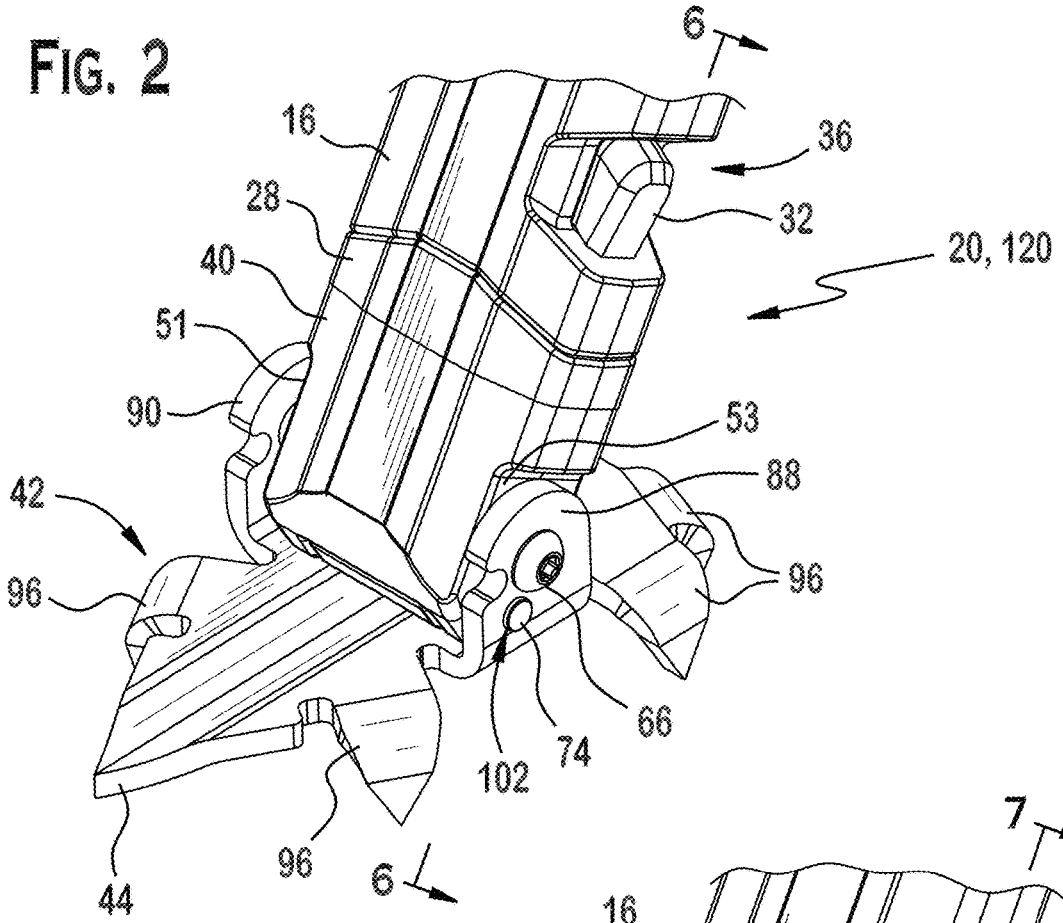
FIG. 2 is a detail view of the starboard variably selectable surface interface of the bipod of FIG. 1, the variably selectable surface interface being shown in a first operable configuration.

Referring to FIGS. 2 and 6, the variably selectable surface interface 20 may include a first configuration 120. In the first configuration 120, the starboard mounting bracket 90 may be spaced from the starboard stop 51, the port stop 53 may block movement of the port mounting bracket 88, and the locking bar 74 may be arranged in the port offset through hole 102. Moreover, the coil spring 72 may bias the drive assembly into the first configuration. In the first configuration 120, the variably selectable surface interface 20 may form a fixed disperse load-bearing support.

Figure 3:
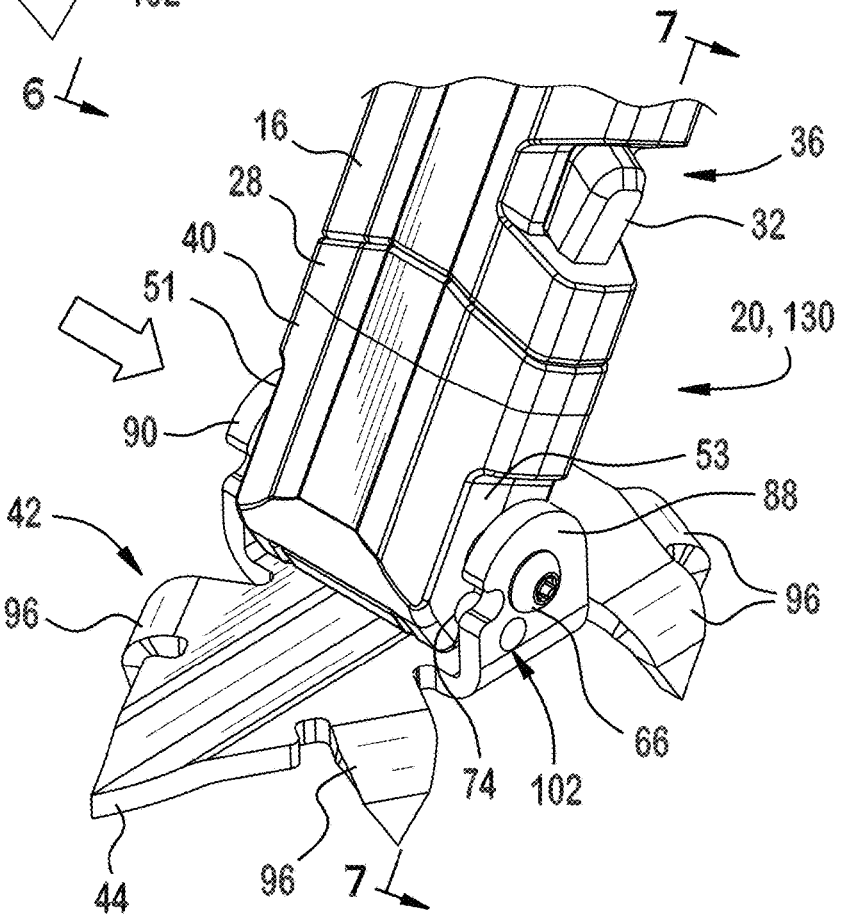
FIG. 3 is a detail view of the starboard variably selectable surface interface of the bipod of FIG. 1, the variably selectable surface interface being shown in a second operable configuration.
Figure 4:
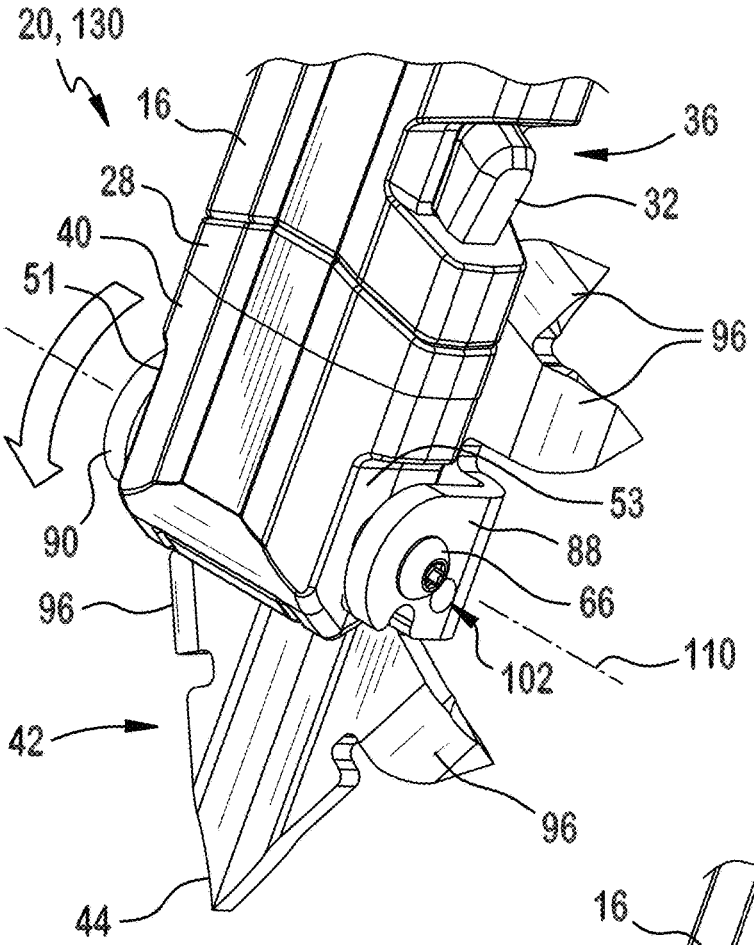
FIG. 4 is a detail view of the starboard variably selectable surface interface of the bipod of FIG. 1, the variably selectable surface interface being shown in a third operable configuration.

Referring to FIGS. 3, 4 and 7, the variably selectable surface interface 20 may include a second configuration 130. In the second configuration 130, the port mounting bracket 88 may be spaced from the port stop 51, the starboard stop 51 may block movement of the starboard mounting bracket 90, and the locking bar 74 may be disengaged from the port offset through hole 102. Generally, a force 135 may be applied by an operator to the starboard fastener 68 or starboard mounting bracket 90 to compress the coil spring 72 and move the drive assembly from the first configuration 120 into the second configuration 130. In the second configuration 130, the variably selectable surface interface 20 may rotate about the transverse axis 110. See e.g., FIG. 4.

Figure 5:
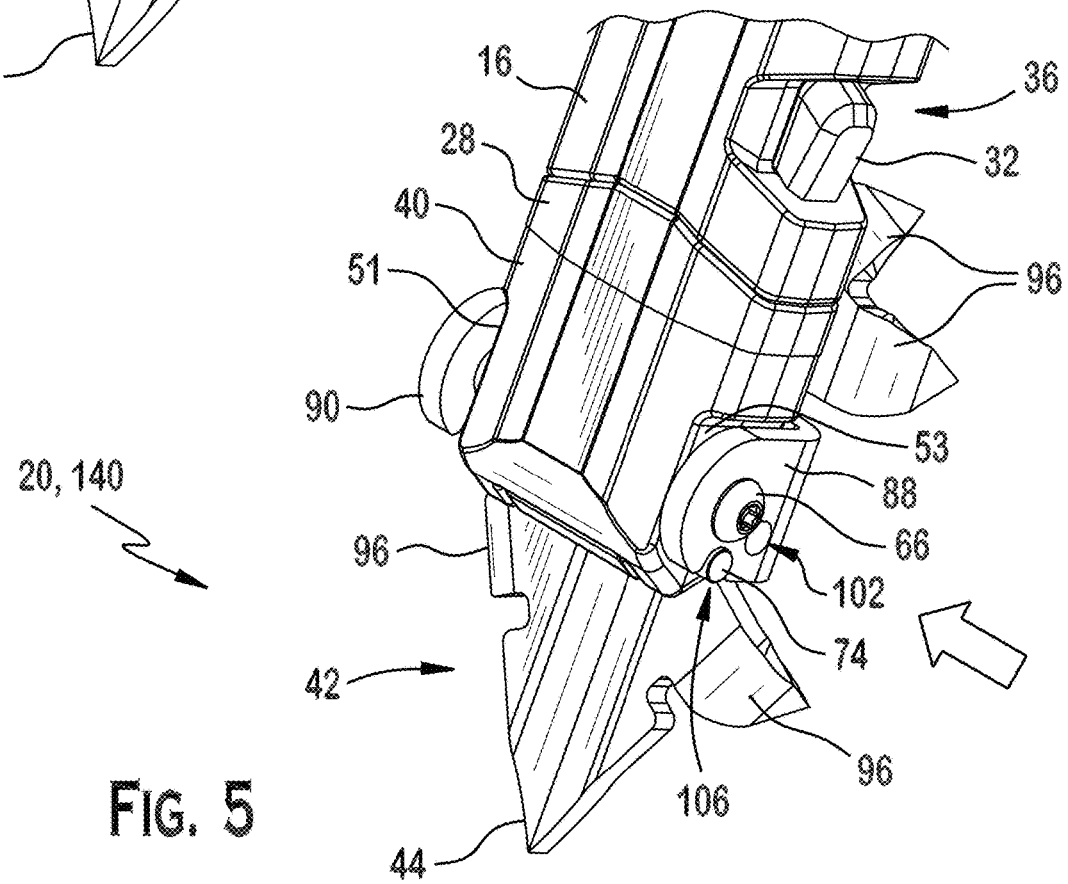
FIG. 5 is a detail view of the starboard variably selectable surface interface of the bipod of FIG. 1, the variably selectable surface interface being shown in a fourth operable configuration.

Referring to FIG. 5, the variably selectable surface interface 20 may include a third configuration 140. In the third configuration 140, the starboard mounting bracket 90 may be spaced from the starboard stop 51, the port stop 53 may block movement of the port mounting bracket 88, and the locking bar 74 may be arranged in the port notch 106. Moreover, the coil spring 72 may bias the drive assembly into the third configuration. Generally, the coil spring 72 may expand to reposition the drive assembly from the third configuration into the second configuration. In the third configuration, the variably selectable surface interface 20 may form a fixed frictional force or point force load-bearing support.

In use, the bipod may be arranged in a stowed configuration. In the stowed configuration the starboard bipod support and the port bipod support may be positioned adjacent to the handguard assembly. In the stowed configuration, the variably selectable surface interface on the starboard bipod support and the variably selectable surface interface on the port bipod support may be arranged in the third configuration. An operator may deploy the starboard bipod support or the port bipod support by repositioning the starboard bipod support or the port bipod support. To provide a desired interface between the starboard bipod support or the port bipod support and a surface, the operator may drive the spike of the starboard bipod support or the port bipod support into the surface. Alternatively, the operator may manipulate the starboard bipod support or the port bipod support to the second configuration and rest the starboard bipod support or the port bipod support on the surface. For instance, the third configuration may provide a preferred bipod support for surfaces that are too weak or compressible to otherwise support the firearm. Additionally, an operator may remove the variably selectable surface interface by depressing the latch to unlock the anchor base from the modular receptacle. The operator may then remove the anchor base of the ASI from the modular support. The operator may then insert another distal support having a similar anchor base into the modular receptacle. Further, the operator may secure the other distal support by locking the anchor base of the other distal support into the modular receptacle by interlocking the latch of the anchor base and the catch of the modular receptacle opening. The other distal support may include a rubberized foot. Similarly, the bipod may be provided with a rubberized foot on each of the distal supports, and the operator may replace each rubberized foot with a variably selectable surface interface.

While it has been illustrated and described what at present are considered to be preferred embodiments of the invention, it will be understood by those skilled in the art that various changes and modifications may be made, and equivalents may be substituted for elements thereof without departing from the true scope of the invention. For example, the profile of the variably selectable surface interface may be adapted for use with a particular firearm, or tactical requirement. Therefore, it is intended that the invention not be limited to the particular embodiments disclosed herein. Rather, the accompanying scope of protection and their equivalents are intended to cover such forms or modifications as would fall within the scope and spirit of the following claims.

What is claimed is:

1. A variably selectable surface interface for a small arms bipod leg comprising:

an anchor for connecting to a small arms bipod leg a body mated to the anchor, the body comprising a proximal receptacle for mating with the anchor, a distal opening spaced from the proximal receptacle along a first longitudinal axis, and a starboard axial bore adjacent to the proximal receptacle and the distal opening, the starboard axial bore comprising a second longitudinal axis, the second longitudinal axis being transverse to the first longitudinal axis, the starboard axial bore and the articulating surface interface comprising a joint such that the articulating surface interface oscillates about the second longitudinal axis; and a distal support member pivotably connected to the body, the distal support member comprising an articulating surface interface, and a control mechanism for selectively fixing the articulating surface interface with respect to the body, the control mechanism comprising a first disperse load bearing configuration such that the variably selectable surface interface is arranged with respect to the body to form a disperse load bearing support, and a first point force load bearing configuration such that the variably selectable surface interface is arranged with the body to form a point force load bearing support.

2. The variably selectable surface interface of claim 1, wherein the control mechanism comprises a tubular drive cylinder and a coil spring.

3. The variably selectable surface interface of claim 2, wherein the tubular drive cylinder and the coil spring are housed in the body.

4. The variably selectable surface interface of claim 3, wherein the tubular drive cylinder and the coil spring bias the articulating surface interface with respect to the body.

5. The variably selectable surface interface of claim 4, wherein the control mechanism further comprises a locking bar for blocking relative movement between the body and the articulating surface interface.

6. The variably selectable surface interface of claim 5, wherein the articulating surface interface comprises a first receptacle, and in the first disperse load bearing configuration the first receptacle and the locking bar interlock to fix the articulating surface interface with respect to the base to form the disperse load bearing support.

7. The variably selectable surface interface of claim 6, wherein the articulating surface interface further comprises a second receptacle, and in the first point force load bearing configuration the locking bar and the second receptacle interlock to fix the articulating surface interface with respect to the base to form the point force load bearing support.

8. The variably selectable surface interface of claim 1, wherein the anchor comprises a base, a stem and latch.

9. The variably selectable surface interface of claim 8, wherein the anchor is configured and adapted to be selectively received in a small arms bipod leg.

10. The variably selectable surface interface of claim 1, wherein the disperse load bearing support is claw-shaped.

11. The variably selectable surface interface of claim 10, wherein the point force load bearing support is spike-shaped.

12. A method of reconfiguring a bipod for a small arms weapon comprising:

providing a bipod for a small arms weapon comprising a first leg assembly which comprises a rubberized foot;

providing a variably selectable surface interface of claim 1; and replacing the rubberized foot in the first leg assembly with the variably selectable surface interface.

13. A bipod for a small arms weapon comprising:

a head portion for connecting to a small arms weapon;

a first leg assembly connected to the head portion, the first leg assembly comprising a first elongated member, and a first variably selectable surface interface connected to the first elongated member, the first variably selectable surface interface comprising a first anchor interlocked with the first elongated member, and a first body secured to the first anchor, the first body comprising a proximal receptacle for mating with the first anchor, a distal opening spaced from the proximal receptacle along a first longitudinal axis, and a starboard axial bore adjacent to the proximal receptacle and the distal opening, the starboard axial bore comprising a second longitudinal axis, the second longitudinal axis being transverse to the first longitudinal axis, the starboard axial bore and the articulating surface interface comprising a joint such that the articulating surface interface oscillates about the second longitudinal axis; and a first distal support member pivotably connected to the first body to form a first pivot axis about which the first distal support member is free to oscillate, the first pivot axis being transverse to the first longitudinal axis, the first distal support member comprising a first articulating surface interface and a first control mechanism for selectively fixing the first articulating surface interface with respect to the first body, the first control mechanism comprising a first disperse load bearing configuration such that the first variably selectable surface interface is arranged with respect to the first body to form a first disperse load-bearing support, and a first point force load bearing support configuration such that the first variably selectable surface interface is arranged with the first body to form a first point force load bearing support.

14. The bipod of claim 13, wherein the head portion comprises a clamp.

15. The bipod of claim 14, wherein the clamp is configured and dimensioned to be secured to an accessory rail.

16. The bipod of claim 15, wherein the accessory rail is a Picatinny rail.

17. A method of supporting a firearm with a surface comprising:

providing a bipod of claim 13;

securing the head portion to a firearm;

deploying the first leg assembly to support the firearm on a surface;

changing the first variably selectable surface interface from the first disperse load bearing configuration to the first point force load bearing support configuration; and implanting the first variably selectable surface interface into the surface to support the firearm.

18. The method of claim 17 further comprising replacing the first variably selectable surface interface with another distal support which comprises a rubberized foot.

19. The bipod of claim 13, further comprising:

a second leg assembly connected to the head portion, the second leg assembly comprising a second elongated member, and a second variably selectable surface interface connected to the second elongated member, the second variably selectable surface interface comprising a second body connected to the second elongated member; and a second distal support member pivotably connected to the second body, the second distal support member comprising a second articulating surface interface and a second control mechanism for selectively fixing the second articulating surface interface with respect to the second body, the second control mechanism comprising a second disperse load bearing configuration such that the second variably selectable surface interface is arranged with respect to the second body to form a second disperse load-bearing support, and a second point force load bearing support configuration such that the second variably selectable surface interface is arranged with the second body to form a second point force load bearing support.

* * * * *